US006989837B2

(12) United States Patent
Gu et al.

(10) Patent No.: US 6,989,837 B2
(45) Date of Patent: Jan. 24, 2006

(54) SYSTEM AND METHOD FOR PROCESSING MEMORY WITH YCBCR 4:2:0 PLANAR VIDEO DATA FORMAT

(75) Inventors: Jin-Ming (James) Gu, Cupertino, CA (US); Harish Aepala, Dublin, CA (US); Viswanathan Krishnamurthi, Fremont, CA (US)

(73) Assignee: S3 Graphics Co., Ltd., British West Indies (KY)

( * ) Notice: Subject to any disclaimer, the term of this patent is extended or adjusted under 35 U.S.C. 154(b) by 51 days.

(21) Appl. No.: 10/321,320

(22) Filed: Dec. 16, 2002

(65) Prior Publication Data

US 2004/0113913 A1 Jun. 17, 2004

(51) Int. Cl.
*G09G 5/36* (2006.01)

(52) U.S. Cl. ..... 345/558; 345/559; 345/503; 345/531; 345/537; 345/547; 348/714; 348/715; 348/716

(58) Field of Classification Search ..... 345/501, 345/503, 520, 531, 536, 537, 545, 547, 558, 345/559; 348/714, 715, 716
See application file for complete search history.

(56) References Cited

U.S. PATENT DOCUMENTS 5,852,451 A 12/1998 Cox et al. ..... 345/509
5,945,997 A 8/1999 Zhao et al. ..... 345/430
5,977,933 A * 11/1999 Wicher et al. ..... 345/3.1
5,999,654 A * 12/1999 Toujima et al. ..... 382/232
6,058,459 A * 5/2000 Owen et al. ..... 711/151
6,104,416 A * 8/2000 McGuinness ..... 345/544
6,215,822 B1 * 4/2001 Bose et al. ..... 375/240.16
6,304,268 B1 10/2001 Iourcha et al. ..... 345/428
6,608,625 B1 * 8/2003 Chin et al. ..... 345/501
6,614,442 B1 * 9/2003 Ouyang et al. ..... 345/545
6,674,479 B2 * 1/2004 Cook et al. ..... 348/453
2003/0151610 A1 * 8/2003 Kuriakin et al. ..... 345/589

* cited by examiner

*Primary Examiner*—Ulka J. Chauhan
(74) *Attorney, Agent, or Firm*—Anthony B. Diepenbrock, III; Dechert LLP

(57) ABSTRACT

A system and method for processing YCbCr video data stored in a paged memory with reduced page breaks. A method is disclosed for retrieving YCbCr planar video data in 4:2:0 format from paged memory. A page of the paged memory containing Y data is accessed; Y data corresponding to M pixels of video data is then retrieved, where M is a value greater than or equal to two. The retrieved Y data is then stored in a shift register. Similar steps are taken to access, retrieve and store Cb and Cr data. Within the shift register, the Y, Cb, and Cr data is stored as sets of planar video data. The Y, Cb, and Cr data is retrieved from the shift register as a series of pixel data for generating pixels on a video display unit.

35 Claims, 11 Drawing Sheets

| 152 Pixel $P_0$ | 154 Pixel $P_1$ | 156 Pixel $P_2$ | 158 Pixel $P_3$ | |
|---|---|---|---|---|
| $Y_{7-0}$ | $Y_{7-1}$ | $Y_{7-2}$ | $Y_{7-3}$ | 8 bits |
| $Y_{6-0}$ | $Y_{6-1}$ | $Y_{6-2}$ | $Y_{6-3}$ | |
| $Y_{5-0}$ | $Y_{5-1}$ | $Y_{5-2}$ | $Y_{5-3}$ | |
| $Y_{4-0}$ | $Y_{4-1}$ | $Y_{4-2}$ | $Y_{4-3}$ | |
| 164 $Y_{3-0}$ | 166 $Y_{3-1}$ | 168 $Y_{3-2}$ | 170 $Y_{3-3}$ | |
| $Y_{2-0}$ | $Y_{2-1}$ | $Y_{2-2}$ | $Y_{2-3}$ | |
| $Y_{1-0}$ | $Y_{1-1}$ | $Y_{1-2}$ | $Y_{1-3}$ | |
| $Y_{0-0}$ | $Y_{0-1}$ | $Y_{0-2}$ | $Y_{0-3}$ | |
| $Cb_{7-0}$ | $Cb_{7-1}$ | $Cb_{7-2}$ | $Cb_{7-3}$ | 8 bits |
| $Cb_{6-0}$ | $Cb_{6-1}$ | $Cb_{6-2}$ | $Cb_{6-3}$ | |
| $Cb_{5-0}$ | $Cb_{5-1}$ | $Cb_{5-2}$ | $Cb_{5-3}$ | |
| $Cb_{4-0}$ | $Cb_{4-1}$ | $Cb_{4-2}$ | $Cb_{4-3}$ | |
| 176 $Cb_{3-0}$ | 178 $Cb_{3-1}$ | 180 $Cb_{3-2}$ | 182 $Cb_{3-3}$ | |
| $Cb_{2-0}$ | $Cb_{2-1}$ | $Cb_{2-2}$ | $Cb_{2-3}$ | |
| $Cb_{1-0}$ | $Cb_{1-1}$ | $Cb_{1-2}$ | $Cb_{1-3}$ | |
| $Cb_{0-0}$ | $Cb_{0-1}$ | $Cb_{0-2}$ | $Cb_{0-3}$ | |
| $Cr_{7-0}$ | $Cr_{7-1}$ | $Cr_{7-2}$ | $Cr_{7-3}$ | 8 bits |
| $Cr_{6-0}$ | $Cr_{6-1}$ | $Cr_{6-2}$ | $Cr_{6-3}$ | |
| $Cr_{5-0}$ | $Cr_{5-1}$ | $Cr_{5-2}$ | $Cr_{5-3}$ | |
| 188 $Cr_{4-0}$ | 190 $Cr_{4-1}$ | 192 $Cr_{4-2}$ | 194 $Cr_{4-3}$ | |
| $Cr_{3-0}$ | $Cr_{3-1}$ | $Cr_{3-2}$ | $Cr_{3-3}$ | |
| $Cr_{2-0}$ | $Cr_{2-1}$ | $Cr_{2-2}$ | $Cr_{2-3}$ | |
| $Cr_{1-0}$ | $Cr_{1-1}$ | $Cr_{1-2}$ | $Cr_{1-3}$ | |
| $Cr_{0-0}$ | $Cr_{0-1}$ | $Cr_{0-2}$ | $Cr_{0-3}$ | |

24 bits

150

FIG. 1B (Prior Art)

| Pixel $P_0$ (252) | Pixel $P_1$ (254) | Pixel $P_2$ (256) | Pixel $P_3$ (258) |
|---|---|---|---|
| $Y_{7-0}$ | $Y_{7-1}$ | $Y_{7-2}$ | $Y_{7-3}$ |
| $Y_{6-0}$ | $Y_{6-1}$ | $Y_{6-2}$ | $Y_{6-3}$ |
| $Y_{5-0}$ | $Y_{5-1}$ | $Y_{5-2}$ | $Y_{5-3}$ |
| 264 $Y_{4-0}$ | 266 $Y_{4-1}$ | 268 $Y_{4-2}$ | 270 $Y_{4-3}$ |
| $Y_{3-0}$ | $Y_{3-1}$ | $Y_{3-2}$ | $Y_{3-3}$ |
| $Y_{2-0}$ | $Y_{2-1}$ | $Y_{2-2}$ | $Y_{2-3}$ |
| $Y_{1-0}$ | $Y_{1-1}$ | $Y_{1-2}$ | $Y_{1-3}$ |
| $Y_{0-0}$ | $Y_{0-1}$ | $Y_{0-2}$ | $Y_{0-3}$ |
| $Cb_{7-0}$ | $Cr_{7-0}$ | $Cb_{7-2}$ | $Cr_{7-2}$ |
| $Cb_{6-0}$ | $Cr_{6-0}$ | $Cb_{6-2}$ | $Cr_{6-2}$ |
| $Cb_{5-0}$ | $Cr_{5-0}$ | $Cb_{5-2}$ | $Cr_{5-2}$ |
| 276 $Cb_{4-0}$ | 282 $Cr_{4-0}$ | 280 $Cb_{4-2}$ | 284 $Cr_{4-2}$ |
| $Cb_{3-0}$ | $Cr_{3-0}$ | $Cb_{3-2}$ | $Cr_{3-2}$ |
| $Cb_{2-0}$ | $Cr_{2-0}$ | $Cb_{2-2}$ | $Cr_{2-2}$ |
| $Cb_{1-0}$ | $Cr_{1-0}$ | $Cb_{1-2}$ | $Cr_{1-2}$ |
| $Cb_{0-0}$ | $Cr_{0-0}$ | $Cb_{0-2}$ | $Cr_{0-2}$ |

8 bits 8 bits 16 bits

250

FIG. 2B (Prior Art)

*Legend* 404

SYSTEM AND METHOD FOR PROCESSING MEMORY WITH YCBCR 4:2:0 PLANAR VIDEO DATA FORMAT

FIELD OF THE INVENTION

The present invention relates to the field of image processing. More particularly, the present invention relates to improving the access to a frame buffer containing 4:2:0 format video data.

DESCRIPTION OF THE RELATED ART

The human eye has three types of photoreceptor cells called cones. Each of the three types of cones responds differently to light of different wavelengths. Accordingly, light with different wavelength content is perceived as light of different color. Color display systems have existed for a long time with knowledge of how human perception works; however, the manner of displaying colors on electronic systems continues to develop.

A basic color display system uses an RGB color system. In such a system, R corresponds to a red color source, G to a green color source and B to a blue color source. By selecting the wavelength content of the RGB color sources, a color gamut is achieved. Thus by blending or combining different amounts of either the red, green, or blue source, a wide range of colors can be achieved. From this color gamut, it is therefore important to mathematically represent a color from a set of colors. Such mathematical representation is called a color space.

RGB is an additive color system in which the three primary colors red, green, and blue are added to form a desired color. In the RGB color space, each component has a range of 0 to 255. When the three sources are at zero, the resulting color is black; when the three sources are at 255, the resulting color is white.

For an RGB color system, an RGB color space can be used. There are, however, other color spaces available including YIQ, YUV, YCbCr, and CMYK. Mathematical conversions are available to convert from one color space to another. Of particular interest in the present invention, is the YCbCr color space which is commonly used in broadcast and television systems as well as computer graphics implementations.

Different color spaces have historically evolved for different applications. In each case, a color space was chosen for reasons that may no longer be applicable. A choice may have been made on a particular color space because certain mathematical elements were simpler or faster to process. The reason for a particular choice may have been reduced memory requirements or reduced bandwidth on digital buses.

Whatever historical reasons caused color space choices in the past, the convergence of computers, the Internet, and a wide variety of video devices, all using different color representations, now forces the digital designer today to convert between them. The objective is to have a common color space to which all inputs are converted before algorithms and processes are executed. The converters are useful for a number of markets, such as image processing and filtering. Their basic function is to convert from one color space to another.

Turning to another widely used color space, the YCbCr color space was developed as part of the Recommendation ITU-R BT.601 as a worldwide digital component video standard and is used in television transmissions. YCbCr is a scaled and offset version of the YUV color space, in which Y represents luminance (or brightness), U and V components represent the color information of hue and saturation. In the YCbCr color space, the RGB color space is separated into a luminance part, Y, and two chrominance parts, Cb and Cr. A historical reason for choosing YCbCr over RGB is that YCbCr reduces storage and bandwidth requirements. In developing the YCbCr color space, it was considered that the human eye is more sensitive to a change in brightness than a change in color.

To generate the same color in the RGB format, all three-color components should be of equal bandwidth. This requires more storage space and bandwidth. Also, processing an image in the RGB space is more complex since any change in the color of any pixel requires all the three RGB values to be read, calculations performed, and then stored. However, storing color information in the luminance, chrominance format can help some processing steps to be faster. The result is that Cb and Cr provide the hue and saturation information of the color and Y provides the brightness information of the color. Y is defined to have a range of 16 to 235 and Cb and Cr have a range of 16 to 240 with 128 equal to zero. Because the human eye is less sensitive to Cb and Cr, engineers did not need to transmit Cr and Cb at the same rate as Y. Less storage and bandwidth was needed, resulting in reduced design costs.

Thus, where storage and bandwidth are a design consideration, as in many modem digital graphic systems, the YCbCr color space is the preferred space. Within the YCbCr color space there are various formats including the 4:4:4, 4:2:2, 4:1:1, and the 4:2:0 formats. These various formats provide different levels of compression with certain tradeoffs. The 4:2:0 format, in particular, provides certain compression advantages, but because of the manner in which it is implemented, memory bandwidth becomes a problem. Display systems that implement the 4:2:0 format typically use paged memory devices (e.g., SRAM or DRAM) where the Y, Cb, and Cr information are stored in different pages of memory. Moreover, a typical system retrieves information for two pixels at a time by retrieving two items of Y information, and one item each of Cb and Cr information. Thus, retrieving color information for a pair of pixels in a prior art system, requires three page breaks, each page break being the closing of a page and the opening of a different page. Page breaks are time-consuming operations.

It is therefore desirable to provide a computer display system having a memory with improved memory bandwidth. It is further desirable to provide a computer display system that reduces the number of required memory page breaks needed to display an image.

BRIEF SUMMARY OF THE INVENTION

The present invention discloses a system and method for processing YCbCr video data stored in a paged memory. One embodiment of the present invention is a graphics controller for accessing a memory storing video data on different pages, where the different pages contain Y, Cb or Cr data, for accessing a FIFO storage device storing Y, Cb, and Cr data as sets of planar video data corresponding to M pixels, where M is an integer value greater than one, and for interfacing with a display device that displays YCbCr planar video data in 4:2:0 format. The graphics controller includes a means for controlling the memory, a means for entering data, retrieved from the memory, into the FIFO storage device and a means for unpacking the data. The means for controlling memory is configured to access and retrieve Y, Cb, and Cr data from the different pages of the memory in response to a request to render an image on the display device. The unpacking means is configured to unpack the data in the FIFO storage device for display on a display device.

The present invention provides for displaying of video data with reduced page breaks. Because such page breaks take longer than one clock cycle to execute, the present invention with its reduced number of required page breaks significantly improves memory bandwidth. In another embodiment of the invention, a method is disclosed for retrieving YCbCr planar video data in 4:2:0 format from paged memory. In this method of the invention, a page of the paged memory containing Y data is accessed. Y data corresponding to M pixels of video data is then retrieved, where M is a value greater than or equal to two. The retrieved Y data is then stored in a shift register. Similar steps are taken to access, retrieve and store Cb and Cr data. Within the shift register, the Y, Cb, and Cr data is stored as sets of planar video data. The Y, Cb, and Cr data is retrieved from the shift register as a series of pixel data that can be used to generate pixels on a video display unit.

In another embodiment, each type of data, Y, Cb, and Cr, are retrieved from different pages of the paged memory. In yet another embodiment, each of the accessing steps includes a page break of the paged memory. Another embodiment includes the shift register configured to store sets of information corresponding to pairs of pixels, wherein the sets of information include two items of Y data for one each of Cb and Cr data.

Another aspect of the invention is a video display system for displaying YCbCr planar video data in 4:2:0 format. The system comprises a paged memory, a memory controller, a shift register, a display request unit, a video processor and a display. The paged memory stores each type of Y, Cb, and Cr data on different pages. The memory controller is configured to access and retrieve Y, Cb, and Cr data from the different pages of the paged memory. The shift register is configured to store Y, Cb, and Cr data as sets of planar video data corresponding to M pixels, where M is a value greater than or equal to two. The display request unit is configured to make display requests of the memory controller. Responsive to the display request unit, the memory controller is configured to: access a page of the paged memory containing Y data; retrieve Y data corresponding to M pixels of video data, where M is a value greater than or equal to two; and, store the retrieved Y data in the shift register. The memory controller performs similar tasks for the Cb and Cr data. In the system of the invention, the video processor is configured to retrieve the Y, Cb, and Cr data corresponding to the M pixels from the shift register as a series of pixel data. Moreover, the Y, Cb, and Cr data is stored in the shift register as sets of planar video data. The display of the system of the invention, is configured to display the M pixels.

In another embodiment of the invention, a memory controller is configured to execute a page break to access each of the Y, Cb and Cr data. In yet another embodiment of the invention, the memory controller includes a data bus on which the Y, Cb and Cr data are retrieved from the paged memory to the memory controller. And, in another embodiment of the invention, the video processor is further configured to unpack the retrieved Y, Cb, and Cr data.

BRIEF DESCRIPTION OF THE DRAWINGS

These and other features, aspects and advantages of the present invention will become better understood with regard to the following description, appended claims, and accompanying drawings where:

FIG. 1B is a table depicting a bit-wise formatting of the YCbCr 4:4:4 format;

FIG. 2B is a table depicting a prior art bit-wise formatting of the YCbCr 4:2:2 format;

DETAILED DESCRIPTION OF THE INVENTION

Figure 1A:
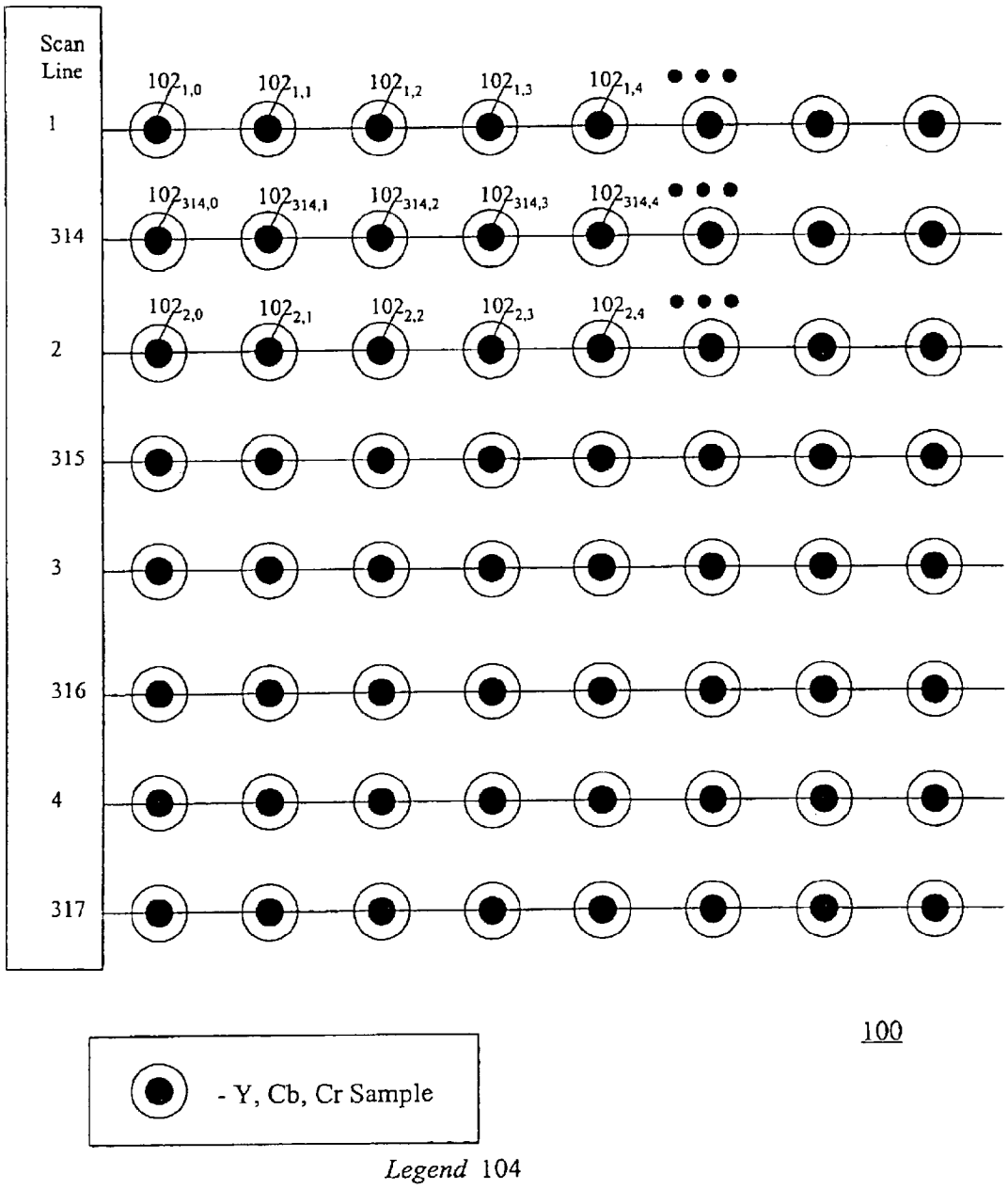
FIG. 1A (Prior Art)
FIG. 1A is a diagram showing a prior art positioning of Y, Cb, and Cr samples according to the YCbCr 4:4:4 format.

The present invention is particularly applicable to the YCbCr color space and certain of its formats. To fully understand the present invention, however, it is first important to understand the concepts of RGB and YUV color spaces, as well as various other YCbCr color formats. Accordingly, these will first be described in the context of the present invention.

The RGB color space is widely used in computer graphics implementations. As discussed on above, red, green and blue are the three primary additive colors. In the RGB color space, the colors are represented by a three-dimensional, Cartesian coordinate system. Being one of the earliest-used color spaces, the RGB color space is also the most prevalent in the electronics industry and most display media such as CRT displays or flatscreen displays use the RGB space. However, the RGB color space has a major deficiency when switching between different colors. Specifically, to change the intensity of a particular image or pixel, the intensity of each source, R, G, and B, must be changed.

A different color space, the YUV color space, is extensively used by the Phase Alternation Line (PAL). An important feature of the YUV color space, typically used in these video systems, is its backwards compatibility with black-and-white systems because the luminance Y and chrominance signals U, V are kept separate. Black-and-white systems used only luminance information and color systems use luminance and chrominance information. Thus, a black-and-white system can still display a normal black-and-white image and a color system can use the supplemental information to display a color image by decoding the additional U and V information. In fact, equations exist to convert between an RGB color system and a YUV color system. For example, a color image described in a gamma-corrected RGB color space can be converted to the PAL YUV color space using the following equations for the values Y, U, and V:

$$Y=0.299R'+0.587G'+0.114B'$$

$$U=0.492(B'-Y)$$

$$V=0.877(R'-Y)$$

Here, gamma correction refers to the correction for non-linearities in a display system such as the non-linearities involved in a cathode ray tube (CRT). The prime mark (i.e., the ') indicates a gamma-corrected value. Using algebraic manipulation of the above equations, gamma-corrected RGB values can be obtained from YUV values:

$$R'=Y+1.140V$$

$$G'=Y-0.394U-0.580V$$

$$B'=Y+2.030U$$

Another color space of particular interest for the present invention is the YCbCr color space. The YCbCr color space was developed as part of Recommendation ITU-R BT.601 (formerly CCIR-601) during the development of a world-wide digital component video standard. YCbCr is a scaled and offset version of the YUV color space. Y is defined to have a nominal range of 16 to 235. Moreover, Cb and Cr are defined to have a range of 16 to 240, with the value 128 equal to zero. Importantly, there are several YCbCr sampling formats, including 4:4:4, 4:2:2, 4:1:1, and 4:2:0. A color image described in a gamma-corrected RGB color space can be converted to the YCbCr color space using the following equations for the values Y, U, and V:

$$Y=0.257R'+0.504G'+0.098B'+16$$

$$Cr=0.439R'-0.368G'-0.071B'+128$$

$$Cb=-0.148R'-0.291G'+0.439B'+128$$

Using algebraic manipulation of the above equations, gamma-corrected RGB values can be obtained from YCbCr values:

$$R'=1.164(Y-16)+1.596(Cr-128)$$

$$G'=1.164(Y-16)-0.813(Cr-128)-0.392(Cb-128)$$

$$B'=1.164(Y-16)+2.017(Cb-128)$$

Note that variations may exist for conversion formulas in order to accommodate certain considerations of interest to a system designer.

FIG. 1A shows the positioning of YCbCr samples 100 for the 4:4:4 format. Each sample $\mathbf{102}_{x,y}$ has a Y value, a Cb value, and a Cr value (see legend 104 in FIG. 1A; also note that the subscript, x,y, is used to designate the coordinates of the Y samples). In consumer applications, because each sample is typically eight bits, each pixel requires 24 bits. In FIG. 1A, the image is displayed using a 625-line interlaced implementation such that the $314^{th}$ line is scanned between the $1^{st}$ and $2^{nd}$ lines. Other lines are similarly interlaced.

FIG. 1B shows the 4:4:4 format in Table-1 150. According to the figure, for the four pixels, $P_0$ 152 through $P_3$ 158, in the table, four Y values, $Y_0$ 164 through $Y_3$ 170, four Cb values $Cb_0$ 176 through $Cb_3$ 182, and four Cr values, $Cr_0$ 188 through $Cr_3$ 194, are needed. Therefore, when each Y, Cb, and Cr are eight bit values, (32+32+32)/4=24 bits are used at any one time.

Figure 2A:
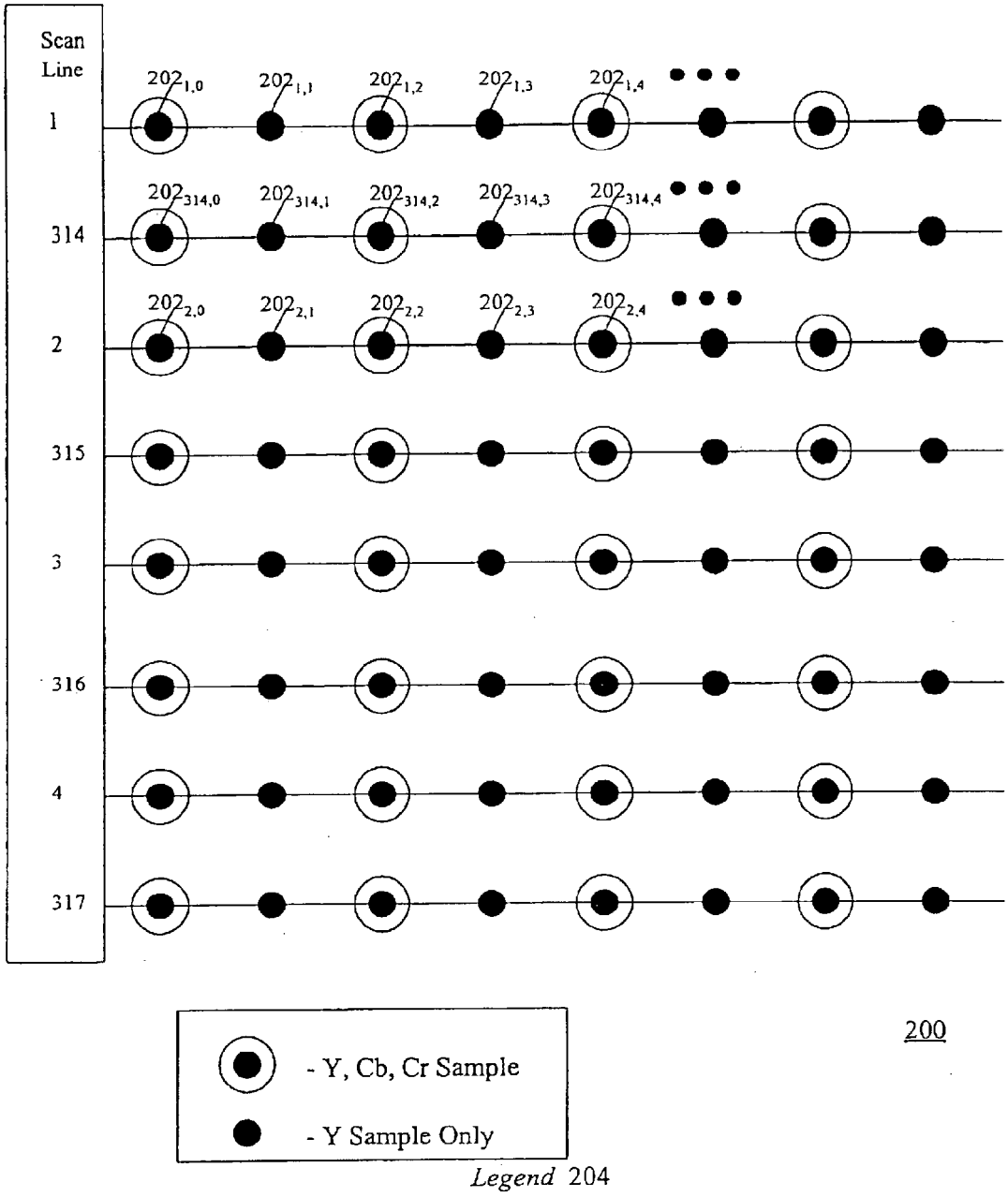
FIG. 2A (Prior Art)
FIG. 2A is a diagram illustrating a prior art positioning of Y, Cb, and Cr samples according to the YCbCr 4:2:2 format.

FIG. 2A shows the positioning of YCbCr samples 200 for the 4:2:2 format. In this format, for every two horizontal Y $\mathbf{202}_{x,y}$ samples, there is one Cb and one Cr sample (see legend 204 in FIG. 2A). As before, each sample is typically 8 bits so that each pixel requires (32+32)/4=16 bits, typically formatted as shown in the Table-2 250 of FIG. 2B.

According to FIG. 2B, for six pixels, $P_0$ 252 through $P_3$ 258, in the table, four Y values, $Y_0$ 264 through $Y_3$ 270, are needed while only two values for each of Cb, $Cb_0$ 276 and $CB_2$ 280, and Cr, $Cr_0$ 282 and $Cr_2$ 284, are needed. Note that the subscripts for Cb and Cr use only even numbers while Y uses both even and odd numbers. In this format, during display, when a Y sample has no CB or Cr data associated with it, data from the previous and next samples of Cb and Cr is interpolated to create the Cb and Cr data.

Figure 3A:
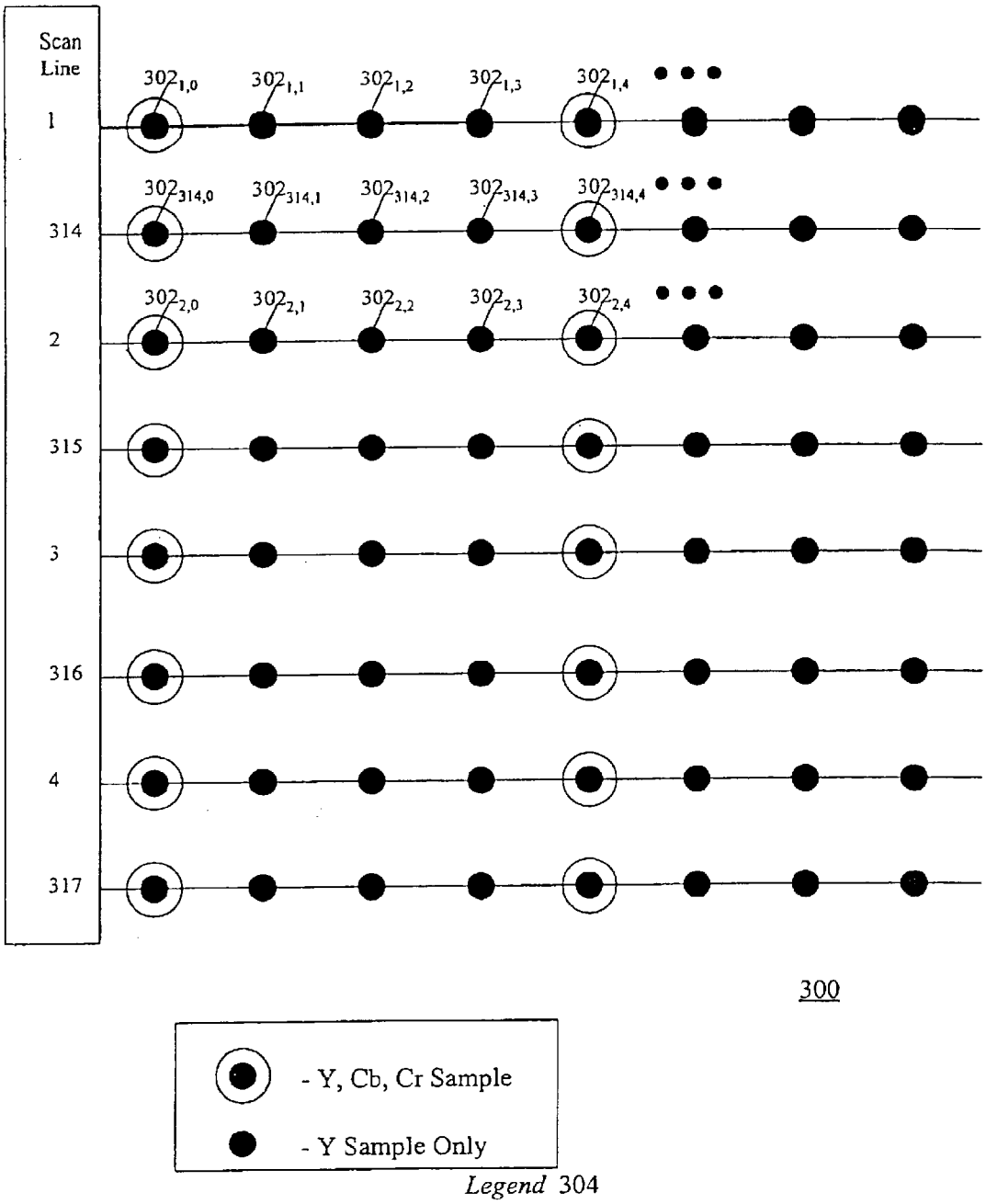
FIG. 3A (Prior Art)
FIG. 3A is a diagram showing a prior art positioning of Y, Cb, and Cr samples according to the YCbCr 4:1:1 format.

FIG. 3A shows the positioning of YCbCr samples 300 for the 4:1:1 format. The 4:1:1 is an older format has been used extensively in consumer video applications, however, more recently, the 4:2:2 format has found wider use. In the 4:1:1 format, for every four horizontal Y $\mathbf{302}_{x,y}$ samples, there is one Cb and one Cr sample (see legend 304 in FIG. 3A), but there is full resolution in the vertical direction, i.e., for every four horizontal Y samples there are four samples of Cb and four samples of Cr. If each sample is 8 bits so that each pixel requires (32+16)/4=12 bits on the average horizontally, typically formatted as shown in the Table-3 350.

Figure 3B:
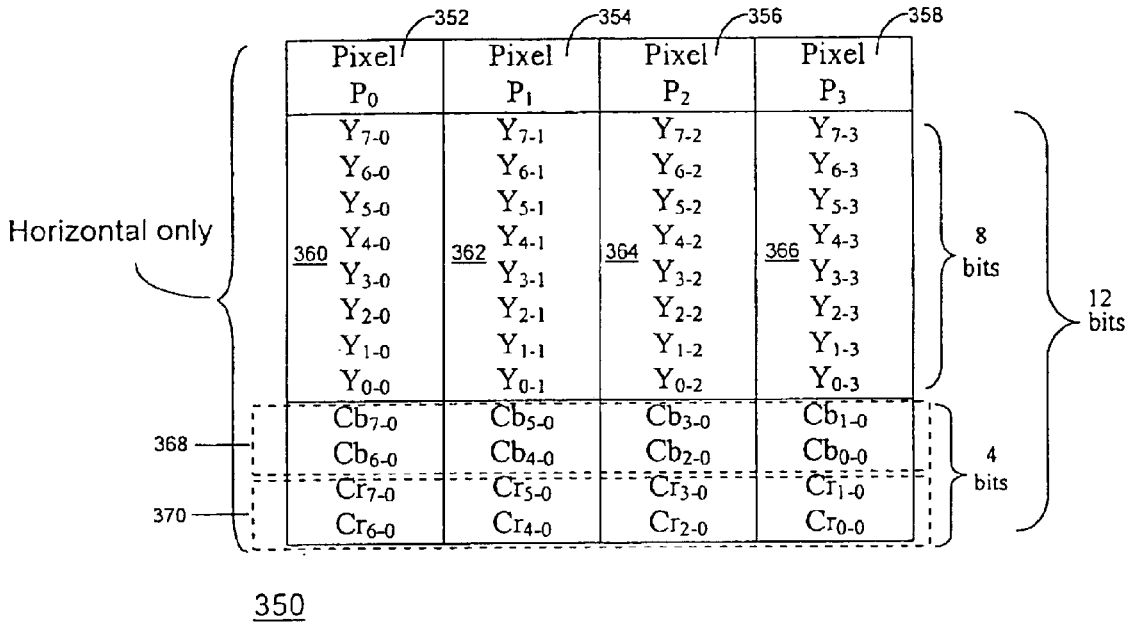
FIG. 3B (Prior Art)
FIG. 3B is a table depicting a prior art bit-wise formatting of the YCbCr 4:1:1 format.

As shown in FIG. 3B, for four pixels $P_0$ 352 through $P_3$ 358 represented in the table, four Y values, $Y_0$ 360 through $Y_3$ 366 are needed while only one value is needed for each of Cb, $Cb_0$ 368, and Cr, $Cr_0$ 370 in the horizontal direction. In this format during display, when Y samples have no Cb or Cr data associated with them, Cb and Cr data are interpolated from the previous and next samples of Cb and Cr.

Figure 4A:
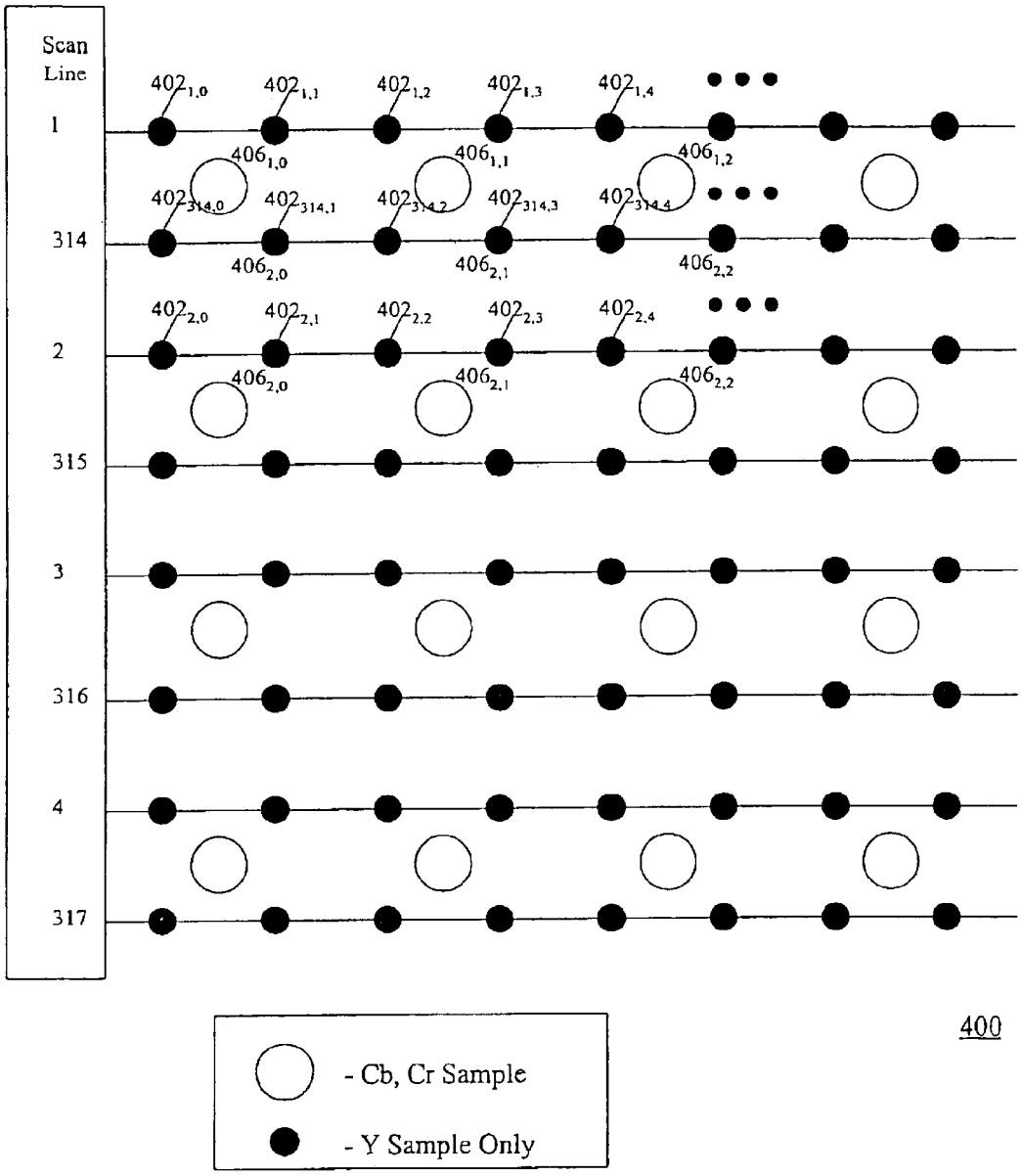
FIG. 4A (Prior Art)
FIG. 4A is a diagram showing a prior art positioning of Y, Cb, and Cr samples according to the YCbCr 4:2:0 format.
Figure 4B:
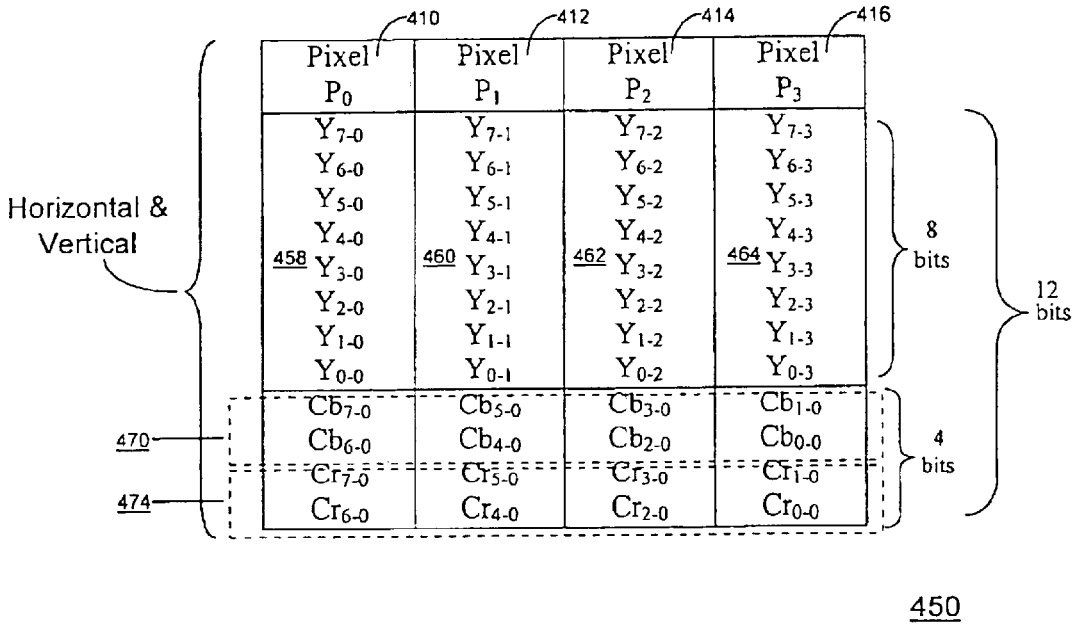
FIG. 4B (Prior Art)
FIG. 4B is a table depicting a prior art bit-wise formatting of the YCbCr 4:2:0 format.

FIG. 4A shows the positioning of YCbCr samples 400 for the 4:2:0 format. The 4:2:0 format is used by the H.261 and H.263 video teleconferencing standards and the MPEG-1 video compression standard. In the 4:2:0 format, for every separate pair of horizontal and for every separate pair of vertical Y samples $\mathbf{402}_{x,y}$, there is one Cb and Cr sample $\mathbf{406}_{x',y'}$ (the prime symbol, ', in the subscript is used to distinguish from the x,y coordinates used for the Y samples; see legend 404 in FIG. 4A). For this reason, the Cb and Cr samples $\mathbf{406}_{x',y'}$ are shown offset to illustrate that the Cb and Cr samples $\mathbf{406}_{x',y'}$ are shared by two scan lines. As before, each sample is typically 8 bits; however, for the 4:2:0 format, information is gathered for two Y samples $\mathbf{402}_{x,y}$ at a time. Thus, for four Y samples $\mathbf{402}_{x,y}$, there is one Cb and one Cr sample $\mathbf{406}_{x',y'}$ such that a total of (32+16)/4=12 bits are used on the average horizontally, typically formatted as shown in the Table-4 450 of FIG. 4B. The table in FIG. 4B is similar to FIG. 3B except that the table applies both horizontally as well as vertically. As show in the figure, for four pixels $P_0$ 410, $P_1$ 412, $P_2$ 414, $P_3$ 416 represented in the table, four Y values, $Y_0$ 458 $Y_1$ 460, $Y_2$ 462, $Y_3$ 464, are needed while only 2 chrominance values are needed, one for Cb, $Cb_0$ through $CB_7$ 470, and one for Cr, $Cr_0$ through $Cr_7$ 474. Therefore, when each Y, Cb, and Cr are eight bit values, a total of 12 bits, on the average, are used at a time. In this format during display, pairs of Y samples $\mathbf{402}_{x,y}$ share CB or Cr samples $\mathbf{406}_{x',y'}$.

Because two different scan lines use common Cb and Cr samples, the Y, Cb, and Cr values are typically stored in different areas of a memory. When the memory is implemented as static random access memory (SRAM) or as dynamic random access memory (DRAM), the memory is either a single data rate (SDR) or double data rate (DDR) type of memory and is typically organized as paged memory. This means that the memory is typically divided into 2, 4 or 8-kilobyte pages, where the size of the page is usually determined by the addressing hardware in use. Within any particular page a certain amount of information is available for retrieval without incurring large time delays. In fact, from within any given page, information contained within its various memory locations can be retrieved at every clock cycle. Of the YCbCr formats discussed here, all but the 4:2:0 format store Y, Cb, and Cr information on the same page. Thus, a color display system not using the 4:2:0 format can quickly retrieve successive sample information because the successive information is usually contained on the same page. In these systems, page breaks are not necessary for every pixel to be rendered.

However, when using the 4:2:0 format, the situation is quite different. A typical prior art system implementing the 4:2:0 format retrieves two Y samples of information where both Y samples are contained within the same page of memory. This system then obtains access to a different page to reach another area of memory containing Cb information. From this page, the system would retrieve one item of Cb information. The system then proceeds to obtain access another page to reach the locations containing Cr information. In order to retrieve Y information for another two pixels, another access to a different page is necessary to reach the location containing Y information. Thus, for two pixels of information, a system implementing the 4:2:0 format requires separate accesses to three different pages. This is an undesirable situation which leads to poor performance when using the 4:2:0 format.

A page access typically requires an extra time of 2 latency clock cycles for what is called pre-charging. Pre-charging is a function performed by paged memory systems when closing an open page and opening a closed page. Thus, it can be seen that page accesses introduce a substantial limitation on memory bandwidth. Because the YCbCr 4:2:0 format uses so many separate page accesses, memory throughput can be a significant problem.

Figure 5:
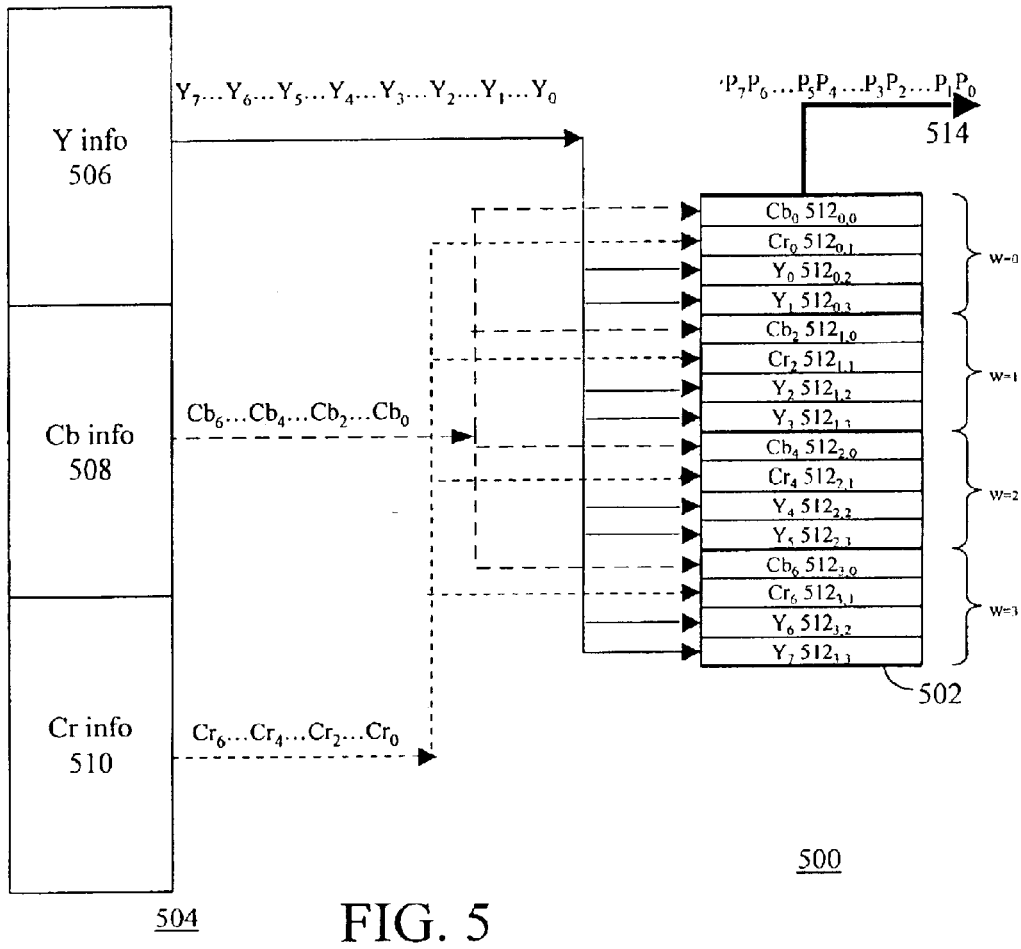
FIG. 5 is a block diagram depicting a method of retrieving Y, Cb, and Cr information in the 4:2:0 format from a paged memory and loading such information into a shift register according to an exemplary embodiment of the invention.

FIG. 5 shows a block diagram of a display system 500 that significantly reduces the number of required page breaks in rendering an image using the YCbCr 4:2:0 format. A FIFO 502 is used for storing information needed to display a predetermined number of pixels, however, other types of hardware elements such as shift registers can be used within the scope of the present invention. For the purposes of illustration and without limitation, the present invention is described for the case of displaying 8 pixels. Further shown in FIG. 5 is a memory 504 organized into at least three different pages 506, 508 and 510. A first page 506 stores Y information; a second page 508 stores Cb information; and an third page 510 stores Cr information. In this embodiment of the invention, 4 items of Cb information, $Cb_0$ through $Cb_6$, are retrieved from page 508 (note that even numbers are used to distinguish the various Cb values), 4 items of Cr information, $Cr_0$ through $Cr_6$, are retrieved from page 510 (note that even numbers are used to distinguish the various Cr values), and 8 items of Y information, $Y_0$ through $Y_7$, are retrieved from page 506, instead of retrieving only 2 items of Y information, This embodiment of the invention, therefore, requires three separate page accesses in order to retrieve information for 8 pixels. Advantageously, this embodiment of the present invention requires only one forth of the page breaks of a prior art system and, therefore, significantly improves memory bandwidth and throughput of a display system implementing the YCbCr 4:2:0 format.

In retrieving information for 8 different pixels in the present invention, it is important to properly associate the various items of Y, Cb, and Cr information. As shown in FIG. 5, FIFO 502 is organized as 4 groups of 4 registers $\mathbf{512}_{w,0}$ through $\mathbf{512}_{w,3}$, where the "w" denotes the group of registers. Each register $\mathbf{512}_{x,3}$ can hold 8 bytes of information. The 4 items of Cb information, $Cb_0$ through $Cb_6$, retrieved from second page 508 of memory 502 are respectively inserted into registers $\mathbf{512}_{0,0}$, and $\mathbf{512}_{1,0}$, and $\mathbf{512}_{2,0}$, and $\mathbf{512}_{3,0}$ of FIFO 502. The 4 items of Cr information, $Cr_0$ through $Cr_6$, retrieved from third page 510 of memory 504 are respectively inserted into registers $\mathbf{512}_{0,1}$, $\mathbf{512}_{1,1}$, and $\mathbf{512}_{2,1}$, and $\mathbf{512}_{3,1}$ of FIFO 502. The 8 items of Y information, $Y_0$ through $Y_7$, retrieved from first page 506 of memory 504, are respectively inserted into the registers $\mathbf{512}_{0,2}$, $\mathbf{512}_{0,3}$, $\mathbf{512}_{1,2}$, $\mathbf{512}_{1,3}$, $\mathbf{512}_{2,2}$, $\mathbf{512}_{2,3}$, $\mathbf{512}_{3,2}$, and $\mathbf{512}_{3,3}$ of FIFO 502. The result is that display information for 8 pixels is properly loaded into FIFO 502 for sequential access. A system implementing the present invention can thereafter read the information from FIFO 502 in a serial manner to form a video pixel stream 514. The FIFO 502 described above may be replaced with asynchronous multiport random access memory (RAM).

Figure 6:
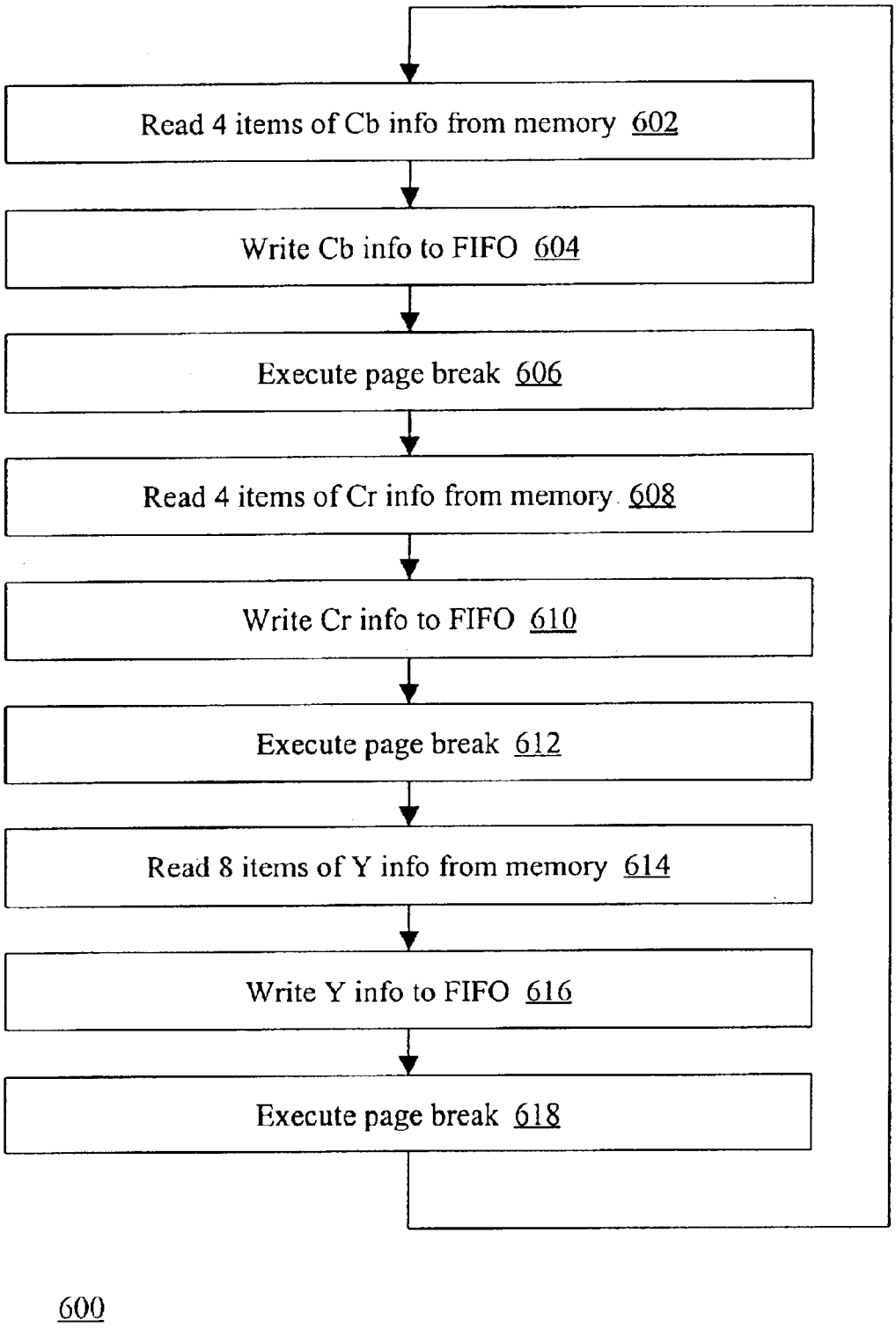
FIG. 6 is a flowchart representation of a method for retrieving Y, Cb, and Cr information in the 4:2:0 format from a paged memory and loading such information into a shift register according to an exemplary embodiment of the invention.

FIG. 6 is a flowchart depicting a method 600 for displaying pixels according to the present invention. At step 602, 4 items of Cb information are read from the paged memory and written to the FIFO at step 604. A new page access is then executed at step 606 to reach the page with the Cr information. At step 608, 4 items of Cr information are read from the paged memory and written to the FIFO at step 610. A new page access is executed at step 612 and 8 items of Y information are read from a paged memory in step 614 and written into a FIFO at step 616 (note the description here is continuing with the example using 8 items of Y information as a non-limiting example). At step 618, another new page access is executed to reach a page containing Cb information so that the method can be repeated.

Figure 7:
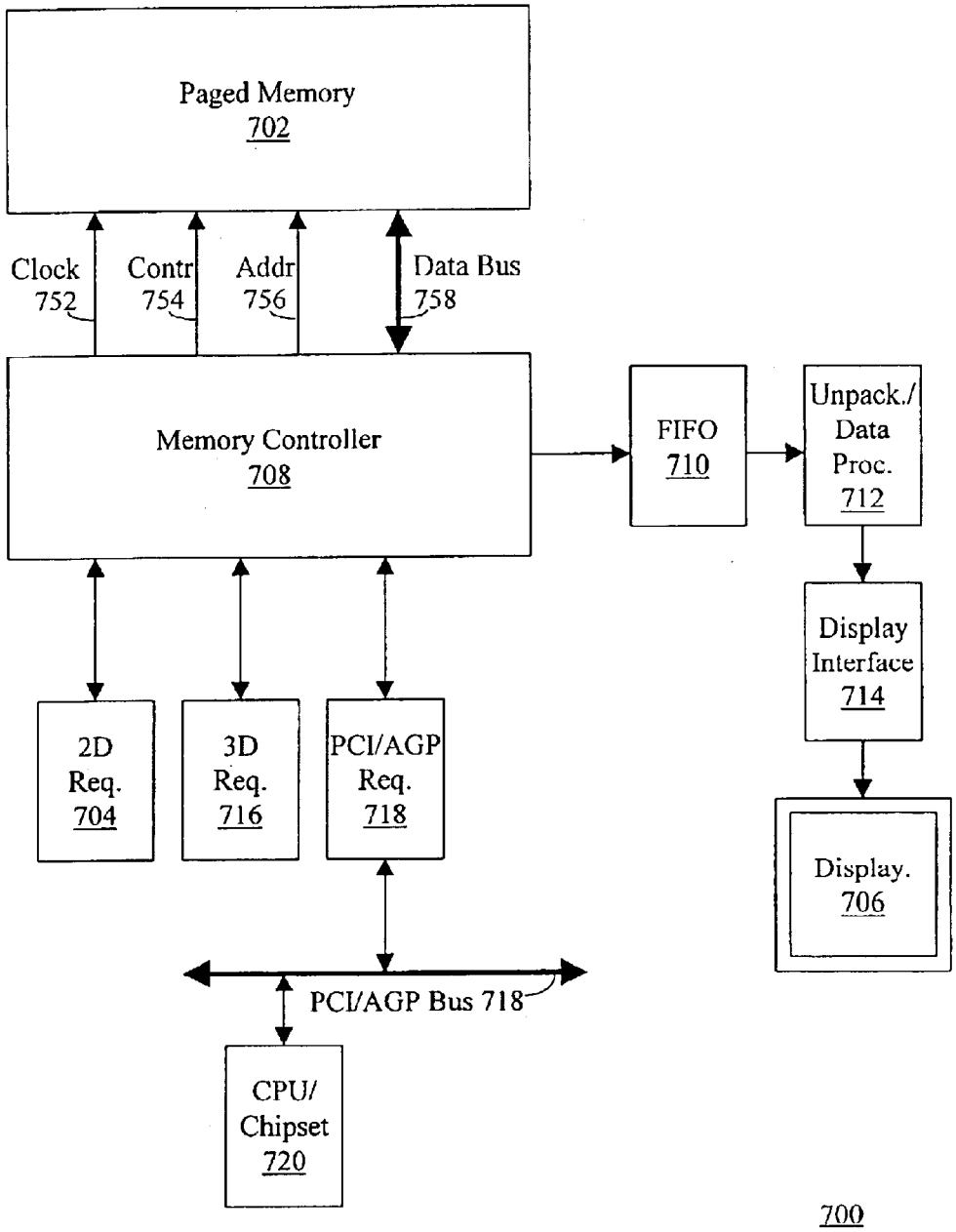
FIG. 7 is a block diagram of a video display system according to an exemplary embodiment of the invention.

FIG. 7 is a color display system 700 according to an exemplary embodiment of the invention. The display system 700 includes a memory 702, a memory controller 708, a 2D requester 704, an alternative 3D requester 716, a PCI/AGP requester 718, a FIFO storage device 710, Unpacking/data processing unit 712, and a display interface 714.

The memory 702 is organized into a plurality of pages and can be either SDR or DDR SRAM or DRAM. The 2D requester 704 connects to the memory controller 708. Memory controller 708 provides clock 752, control 754, and address 756 information to the memory 702. Connected to the memory controller are the 2D requester 704, a 3D requester 716, or a PCI/AGP requester 718, and the FIFO storage device 710. The Unpacking/data processing unit 712 is connected to the output of the FIFO storage device and feeds the display interface 714 to which the actual display device is connected.

The 2D requester 704 requests that display device 706 render a two-dimensional image. To achieve this, the 2D requester 704 directs the memory controller 708 to access memory 702 as previously described so that color information can be entered into the FIFO storage device 710. In response to the request, memory 702 provides Y, Cb, and Cr information through data bus 758 to memory controller 708, which then is directed to the FIFO 710 storage device. Information contained in FIFO 710 is then be read serially by unpacking/data processing unit 712. Unpacking/data processing unit 712 first unpacks information for pairs of pixels and then processes this information for transfer to the display interface 714. Display interface 714 includes any necessary specialized hardware or software for rendering an image on display device 706.

In other embodiments of the invention, display system 700 includes a 3D requester 716 that operates in a similar manner as two dimensional request unit 704. Alternatively, display system 700 includes a PCI/AGP request unit 716 that is communicatively coupled through PCI/AGP bus 718 to a CPU/Chipset 720. In this latter configuration, CPU/Chipset 720 provides the display requests to display system 700.

Although the present invention has been described in considerable detail with reference to certain preferred versions thereof, other versions are possible. For example, display systems 500 and 700 and method 600 may be modified to retrieve more or less than 8 items of Y information. In doing so, the corresponding Cb and Cr information would also be retrieved and handled appropriately. Therefore, the spirit and scope of the appended claims should not be limited to the description of the preferred versions contained herein.

What is claimed is:

1. A method for retrieving YCbCr planar video data in 4:2:0 format, comprising:

accessing a first page of a paged memory to retrieve M pixels of Y data and storing the retrieved Y data in a shift register, where M is an integer value greater than two;

accessing a second page of the memory to retrieve M pixels of Cb data and storing the retrieved Cb data in the shift register;

accessing a third page of the memory to retrieve M pixels of Cr data and storing the retrieved Cr data in the shift register; and retrieving the M pixels of Y, Cb, and Cr data from the shift register for display as a series of pixel data, the M pixels of Y, Cb, and Cr data being stored in the shift register as sets of planar video data.

2. The method of claim 1, wherein the shift register is a first-in-first-out (FIFO) device.

3. The method of claim 1, further including displaying M pixels on a video display using the Y, Cb, and Cr data retrieved from the shift register.

4. The method of claim 1, wherein each of the accessing steps includes closing a page of the memory and opening another page.

5. The method of claim 1, wherein the shift register is configured to store sets of information corresponding to pairs of pixels, and wherein the sets of information include two items of Y data for one each item of Cb and Cr data.

6. A video display subsystem for displaying YCbCr planar video data in 4:2:0 format, comprising:

a memory having a plurality of pages for storing video data, including Y, Cb and Cr data, said Y data, Cb data, and Cr data each being stored on a different page of the paged memory;

a memory controller configured to access and retrieve Y, Cb, and Cr data from the different pages of the paged memory in which the data is stored;

a FIFO storage device configured to store Y, Cb, and Cr data as sets of planar video data corresponding to M pixels, where M is an integer value greater than two;

a display request unit configured to make display requests of the memory controller to access a page of the paged memory, retrieve either Y, Cb or Cr data for the M pixels, and to store the retrieved data in the shift register; and a video processor configured to retrieve the Y, Cb, and Cr data for the M pixels from the FIFO storage device as a pixel stream, the Y, Cb, and Cr data being stored in the FIFO storage device to facilitate access of the pixel stream.

7. The video display system of claim 6, wherein the FIFO storage device is a shift register.

8. The video display system of claim 6, wherein access by the memory controller includes closing a page of the memory and opening another page; and wherein the memory controller is further configured to execute a separate page access to retrieve each of the Y, Cb and Cr data.

9. The video display system of claim 6, wherein the memory controller includes a data bus, connected to the memory, by which the Y, Cb and Cr data are retrieved from the paged memory.

10. The video display system of claim 6, wherein the display request unit is a two-dimensional display request unit configured to make two-dimensional display requests.

11. The video display system of claim 6, wherein the display request unit is a three-dimensional display request unit configured to make three-dimensional display requests.

12. The video display system of claim 6, wherein the display request unit is a bused-request unit communicatively coupled to a central processing unit (CPU) configured to display requests.

13. The video display system of claim 12, wherein the CPU includes a chipset.

14. The video display system of claim 12, wherein the bused-request unit is communicatively coupled to the CPU through a peripheral component interconnect (PCI) bus.

15. The video display system of claim 6, wherein the video processor is further configured to unpack the retrieved Y, Cb, and Cr data.

16. The video display system of claim 6, wherein the video processor includes a display interface configured to facilitate the display of the M pixels on the display.

17. A video display subsystem for displaying YCbCr planar video data in 4:2:0 format, comprising:

first storage means for storing video data on different pages in the storage means, the different pages containing Y, Cb or Cr data;

second storage means for storing Y, Cb, and Cr data as sets of planar video data corresponding to M pixels, where M is an integer value greater than two;

means for controlling the first storage means to access and retrieve Y, Cb, and Cr data from the different pages;

means for entering data into the second storage means;

means for providing display requests to the controlling means to access and retrieve the Y, Cb and Cr data from the different pages and, to the entering means to store the data in the second storing means; and means for retrieving the Y, Cb, and Cr data for the M pixels from second storage means as a series of pixel data, wherein the Y, Cb, and Cr data are stored in the second storing means as sets of planar video data.

18. The video display system of claim 17, wherein the second storing means is a shift register.

19. The video display system of claim 17, wherein the second storing means is a first-in-first-out (FIFO) device.

20. The video display system of claim 17, wherein the controlling means further includes means for closing an open page and opening a closed page to each of the Y, Cb and Cr data.

21. The video display system of claim 17, wherein the controlling means includes means for transferring Y, Cb and Cr data from the first storage means to the controlling means.

22. The video display system of claim 17, wherein the means for providing display requests includes means for providing two-dimensional display requests.

23. The video display system of claim 17, wherein the means for providing display requests includes means for providing three-dimensional display requests.

24. The video display system of claim 17, wherein the means for providing display requests is communicatively coupled to a processing means configured to provide display requests.

25. A memory controller for retrieving YCbCr planar video data in 4:2:0 format, comprising:

means for accessing a page of memory, the page containing either Y, Cr or Cb data for M pixels, where M is an integer value greater than two;

means for retrieving from the page of memory either Y, Cr or Cb data for the M pixels;

means for storing the M pixel data in a shift register; and means for retrieving the Y, Cb and Cr data corresponding to the M pixels from the shift register as a series of pixel data, the Y, Cb, and Cr data being stored in the shift register as sets of planar video data.

26. The memory controller of claim 25, wherein the shift register is a first-in-first-out (FIFO) device.

27. The memory controller as recited in claim 25, wherein each type of data, Y, Cb, and Cr, is retrieved from a different page of the paged memory.

28. The memory controller as recited in claim 25, wherein the shift register is configured to store sets of information corresponding to pairs of pixels; and wherein the sets of information include two items of Y data for each item of Cb and Cr data.

29. A graphics controller device for accessing a memory storing video data on different pages, the different pages containing Y, Cb or Cr data and for interfacing with a display device that displays YCbCr planar video data in 4:2:0 format, the graphics controller device comprising:

means for controlling the memory to access and retrieve Y, Cb, and Cr data from the different pages of the memory in response to a request to render an image on the display device;

storage means for storing Y, Cb, and Cr data as sets of planar video data corresponding to M pixels, where M is an integer value greater than two;

means for entering data, retrieved from the memory, into the storage means; and means for unpacking the data in the storage means for display on a display device.

30. A graphics controller device as recited in claim 29, wherein the storage means is a FIFO storage device.

31. A graphics controller device as recited in claim 29, wherein the storage means is a shift register.

32. A graphics controller device as recited in claim 29, wherein the request received is a 2D request.

33. A graphics controller device as recited in claim 29, wherein the request received is a 3D request.

34. A graphics controller device as recited in claim 29, wherein the request received is a request from a PCI/AGP agent.

35. A graphics controller device for accessing a memory storing video data on different pages, the different pages containing Y, Cb or Cr data, for accessing a FIFO storage device storing Y, Cb, and Cr data as sets of planar video data corresponding to M pixels, M being an integer value greater than two, and for interfacing with a display device that displays YCbCr planar video data in 4:2:0 format, the graphics controller device comprising:

means for controlling the memory to access and retrieve Y, Cb, and Cr data from the different pages of the memory in response to a request to render an image on the display device;

means for entering data, retrieved from the memory, into the FIFO storage device; and means for unpacking the data in the FIFO storage device for display on a display device.

* * * * *